US008970353B2

(12) United States Patent
Lapides

(10) Patent No.: US 8,970,353 B2
(45) Date of Patent: Mar. 3, 2015

(54) ATHLETIC EVENT TIMING AND DISPLAY SYSTEMS

(71) Applicant: John S. Lapides, New Haven, CT (US)

(72) Inventor: John S. Lapides, New Haven, CT (US)

( * ) Notice: Subject to any disclaimer, the term of this patent is extended or adjusted under 35 U.S.C. 154(b) by 0 days.

(21) Appl. No.: 14/304,670

(22) Filed: Jun. 13, 2014

(65) Prior Publication Data

US 2014/0297010 A1 Oct. 2, 2014

Related U.S. Application Data

(63) Continuation of application No. 13/276,057, filed on Oct. 18, 2011, now Pat. No. 8,754,755.

(60) Provisional application No. 61/394,210, filed on Oct. 18, 2010.

(51) Int. Cl.

| | |
|---|---|
| ***G08B 23/00*** | (2006.01) |
| ***A63K 3/00*** | (2006.01) |
| ***G07C 1/24*** | (2006.01) |

(52) U.S. Cl.

CPC .... *A63K 3/00* (2013.01); *G07C 1/24* (2013.01)
USPC ..... 340/323 R; 340/309.9; 340/309.16; 348/157; 463/42; 700/91

(58) Field of Classification Search

USPC ..... 340/323 R, 309.16, 309.9; 348/157; 700/91; 463/6, 42; 455/3.06
See application file for complete search history.

(56) References Cited

U.S. PATENT DOCUMENTS

| | | | | |
|---|---|---|---|---|
| 5,367,286 | A | 11/1994 | Voillat | |
| 6,901,031 | B2 | 5/2005 | Murakoshi et al. | |
| 6,955,542 | B2 | 10/2005 | Roncalez et al. | |
| 7,106,360 | B1 * | 9/2006 | Frederick | 348/157 |
| 7,289,793 | B2 | 10/2007 | Norwood et al. | |
| 7,934,983 | B1 | 5/2011 | Eisner | |
| 8,239,910 | B2 * | 8/2012 | Anderson et al. | 725/118 |
| 2003/0014275 | A1 | 1/2003 | Bearden, III et al. | |
| 2004/0158638 | A1 | 8/2004 | Peters et al. | |
| 2005/0112536 | A1 | 5/2005 | Frayman | |
| 2005/0149966 | A1 * | 7/2005 | Fairhurst et al. | 725/32 |
| 2005/0272020 | A1 | 12/2005 | McGregor et al. | |
| 2006/0097847 | A1 | 5/2006 | Bervoets et al. | |
| 2008/0036587 | A1 | 2/2008 | Meinzen et al. | |
| 2009/0197710 | A1 | 8/2009 | Ronda | |
| 2009/0219785 | A1 | 9/2009 | Van "T Klooster et al. | |
| 2010/0265801 | A1 | 10/2010 | Ehelen et al. | |

* cited by examiner

*Primary Examiner* — Brent Swarthout
(74) *Attorney, Agent, or Firm* — St. Onge Steward Johnston & Reens LLC

(57) ABSTRACT

Presenting comparative timing data to the audience of a sports or other competition multiple within an event, where timing or scoring data is stored during each heat, compared between heats, and displayed. Timing data includes lap times, split times, or other timing information. Timing data from each heat can also be compared with historical timing records such as Olympic, NCAA, or other records. A computing device coupled to timing equipment, storage, and a display operate to gather and store timing data from each heat, compare the timing data to generate comparative timing data, and present the comparative timing data to attendees. A software application running on the computing device allows a user to select particular timing data to compare with the current event timing data. Video and biographical information about a given competitor in the event can also be presented to the user.

27 Claims, 9 Drawing Sheets

ATHLETIC EVENT TIMING AND DISPLAY SYSTEMS

FIELD OF THE INVENTION

The invention relates to athletic event timing, and more specifically to a system and method for generating and displaying comparative timing and scoring data during and after an athletic or other competition with real time data and with historical data.

BACKGROUND OF THE INVENTION

In many kinds of sporting or other competitions, the audience often does not get the experience they might want. In some cases, this can be because there is no way for the audience to participate or interact with the competition, to know who achieves a qualification or scores in an event, or to know the score or projected score of the competition. Many times, however, the audience is simply not provided with enough information to fully understand the competition and enjoy it.

This can be especially true in sports such as swimming, diving, track and field, speed skating, rowing, tennis, auto racing, downhill skiing and other sports where a lack of inter-activity with and among the audience makes it difficult to understand the qualification and scoring process and to project meaningfully what the score might be under various performance outcomes and in this way to know what is going on. Such information however, could serve to increase the audience awareness, participation and interest in the event or heat. A particular problem exists in timed race competitions such as age group, high school and college dual meet and championship meets, zone meets and championships, national championships and international meets and championships including the Olympics, professional competitions and other group or governing body sponsored competitions such as the United States Olympic Committee ("USOC"), the National Collegiate Athletic Association ("NCAA"), USA Swimming ("USA Swimming"), YMCA, and National Governing Bodies, Organizations, and Associations such as Ligue Europeene do Natation ("LEN"), the American Swim Coaches Association ("ASCA"), the National Collegiate Athletic Association and United States Masters Swimming ("USMS"), in the United States and in other countries around the world, where it is possible that there can be many participants competing over a considerable length of time.

This can be problematic in timed race competitions such as swimming competitions where each event within the competition involves a series of smaller or preliminary races known as "heats". In some such events, which are called "timed finals", f multiple heats are run for a particular event and the places scored are based on the fastest heat times. In such cases there are no semi-finals, finals and the like, but instead that the final event results are determined solely by the heat times. In a "timed final" competition, it is very difficult for the audience to know which competitors are in the lead and in what rank they are in the list of competitors that compete.

In addition, while the individual competitors' selected split times, sometimes with cumulative times, are sometimes displayed during the performance of the heat and the final heat time displayed at the conclusion of each heat, there is no ability to customize the split times which an audience member may wish to see nor is there a calculated time comparison between the performances of the current heat and previous heat(s), how the competitor ranks among the performers of previous heats based on the split and total time of each progressive heat and actual and proforma calculated participating team/country scores and/or medal count based on the performances up to that point in the event and/or overall competition and potentially, the projected scores based on the results of the heats and the projection of team scores based on heat results.

In a timed event involving multiple heats which are used to qualify competitors for semi-final or finals heats, it can be similarly quite difficult for the audience to know where an athlete stands relative to their best split (the time for a particular lap split), total times and split times of other competitors (and record performances), and the score and projected score in the event and in the meet as a whole, as the event progresses. This is because after each heat, the times and places are typically posted for that particular heat, but the current best qualifier "times to beat" and related scores are not calculated or displayed the audience. It is often not until the entire event is over that various semi-finals, consolation finals and finals qualifiers are displayed.

In addition, often record performances on lead-off legs of a relay may not be displayed to the audience. For example, in the 2000 Olympics, the lead-off leg of the 4×100 meter free relay, the Australian lead-off swimmer, Michael Klim, set a new world record in the 100 M Free, which was displayed as a time but not a new World Record ("WR") to the audience until the conclusion of the relay. Had the new WR been announced immediately, it would have added immeasurably to the audience's enjoyment of the event.

Individual competitor best times, record times and relative competitor performances are not calculated or displayed in real time (immediately as they happen) and therefore are not known. But in many intramural sports, and age group and collegiate and open swimming and track meets and events, for example, various audience members such as supporters, friends, and family of an athlete are very interested in learning the relative performance in terms of best times and whether they qualify for finals, other zone meet, championship and/or Olympic competitions, or awards during a heat or an event or immediately thereafter.

In team competitions, including but not limited to dual meets, tri-meets, double dual meets and championship meets, certain competitors may qualify for either Bonus, Consolation and Final heats, and team points are awarded for the position which competitors finish. By knowing how many competitors qualify for the various final heats and the position in which they qualified, it is possible to create a proforma event result and projected meet score prior to the actual finals heats being run. In this way, it is possible for the audience to know not only a projected meet score, but also to have a projection of how their competitors would have to place to move their team up in the overall meet score standings and/or to win.

Similarly, such data and scoring could be provided to the audience for sports such as diving and for other sports where scoring or timing of multiple competitors is complex and the overall place and related meet or competition score can not easily be comprehended by the audience or where the data is not displayed during the event in real time or immediately thereafter.

Without such real time comparative information, a frustrating situation arises, where it is difficult for a the audience to become knowledgeable enough to be fully engaged in the experience because they cannot know if an individual swimmer, as an example, has a currently qualifying time for finals, consolation finals, bonus finals and the like, as the heats are run sequentially. A competitor could be achieving split times during their heat that are close to or exceeding the best time in the previous heats, or even a historical record time, and the audience would be largely unaware until the heat is concluded. Without this real time data and information, including calculated projections, there is no way to know the importance of particular competitor's performances or the related projected meet score. This represents an incredible missed opportunity for a coach in planning his/her entries for a meet and for any audience member, but perhaps especially a supporter to experience the thrill of the event in real time and to support their favored competitor, and can diminish the audience's engagement with the event or the sport.

A related problem exists, where splits which are displayed for each competitor are typically displayed for incremental splits which may not be relevant to the event, requiring coaches and the audience to manually add splits to calculate relevant splits for a particular event.

In order to more fully provide engagement with such sporting events, the audience needs an information dashboard that changes the notion of times and data into real time and summary information to enhance the entertainment experience and minimize the need to manually calculate split or lap times in order to rank the performances of competitors in a meaningful way and to calculate event and/or continually updated meet scores both after a particular event or on a proforma basis.

Technologies for managing and presenting sporting event information are known in the art. For example, U.S. Pat. No. 6,955,542 to Roncalez et al. discloses a system for monitoring athlete movement, where movement and timing data is communicated to the swimmer, coaches, and the audience via a display module. However, Roncalez et al. do not teach comparing timing data or related event and meet scores across heats or with historical information.

US Patent Publication No. 2005/0112536 to Frayman discloses a system for recording and delivering sports activity analysis via e.g. a cellular telephone. However, Frayman does not teach comparing timing data or related event and meet scores across heats or with historical information.

US Patent Publication No. 2005/0272020 to McGregor et al. discloses a sporting event logistics system for use by a spectator. A map of a sporting venue with predetermined rendezvous locations marked is provided so that the user is informed when and where to cheer and support a specified participant. The predetermined rendezvous locations are determined with reference to a specific participant's speed or pace, the rate at which the spectator can travel from rendezvous location to rendezvous location, and the availability of viewing locations, public transportation, proximity of restrooms, and the course between rendezvous locations. However, McGregor et al. do not teach comparing timing data or related event and meet scores across heats or with historical information.

US Patent Publication No. 2004/0158638 to Peters et al. discloses conveying event data to a spectator's mobile interface device. A spectator may receive historical as well as current data regarding teams and players participating in a sporting event. However, Peters et al. do not teach comparing timing data or related event and meet scores across heats or with historical information.

US Patent Publication No. 2003/0014275 to Bearden, III et al. discloses distributing real-time data, including commentary and event related data to the audience of a sporting event via hand-held computer, and for enabling the attendees to participate in interactive activities and polling while at the sporting event. However, Bearden, III et al. do not teach comparing timing data or related event and meet scores across heats or with historical information.

It is therefore desired to provide a system and method which addresses these deficiencies.

SUMMARY OF THE INVENTION

Accordingly, it is an object of the present invention to provide a system and method for comparing timing data across heats, events, or with historical information, by which the audience is better informed of the information that they need to address their specific interest. It is another object of the present invention to provide a software application marrying information, media, and comparative timing and scoring data into meaningful information.

These and other objectives are achieved by providing a method of presenting data to the audience of a competition having heats, heats and a final, or multiple heats and multiple finals within an event, where various timing data is stored during each heat, compared between heats, and presented to the audience.

In some embodiments, timing data includes lap times, split times, or other timing or scoring information.

Other objects of the present invention are achieved by a method of presenting data to the audience of a sports competition having heats or a final or multiple heats or finals within an event, where timing data from each heat is compared with historical timing records related to the current event, ranking and/or current results and comparison to historical and record information.

In some embodiments, historical timing records include qualification for zone and national competitions, (including but not limited to qualifying times, often called "cuts" such as NCAA or Olympic trials), and Olympic, NCAA, or other historical timing records.

Further objects of the present invention are achieved by providing a system for presenting data to the audience of a sporting event having heats or a final or multiple heats or finals within an event, comprising a computer coupled to timing equipment, storage, and one or more displays, whether on premises or through a remote location, and Personal Communication Devices, where the computer gathers and stores timing and scoring data from each heat or final, compares the timing data to generate comparative timing and scoring data, and presents the comparative timing and scoring data on the Display(s) and/or other Personal Communication Device(s) of any type, either for use on-site or remote location.

In some embodiments, a software application running on the computer allows an audience member to select particular timing and scoring data to compare with the current event timing and scoring data. Other embodiments provide video and biographical information about a given competitor in the event to the audience.

In some embodiments, a software application running on the computer allows an audience member to select particular participant names or teams to follow for the event and to set alerts which allow the audience member to be informed of an event and or heat or type of competition of interest and to be informed of the relevant schedule of such event or heat. This allows the audience to track individual performers and teams and to view customized information about performance.

Other objects of the invention and its particular features and advantages will become more apparent from consideration of the following drawings and accompanying detailed description.

DETAILED DESCRIPTION OF THE INVENTION

For purposes of this disclosure, an audience includes spectators, participants, officials, coaches, the news media, and any other interested parties either at the site of an event, or at a remote location.

For purposes of this disclosure, a display includes any device or system for displaying information to an audience, including but not limited to scoreboards, television displays, monitors, touchscreens, portable digital assistants, mobile telephones, smartphones, computers, or any personal communications device.

For purposes of this disclosure, a personal communications device includes a mobile device of any type (including devices currently known as called "smartphones", "cellular phones", iPhone™ personal digital devices ("PDA(s)") and/or a computer, laptop, or tablet computer, all of which may operate on a cellular network, the internet, or through a proprietary network, or any other suitable computing device or network.

Figure 1:
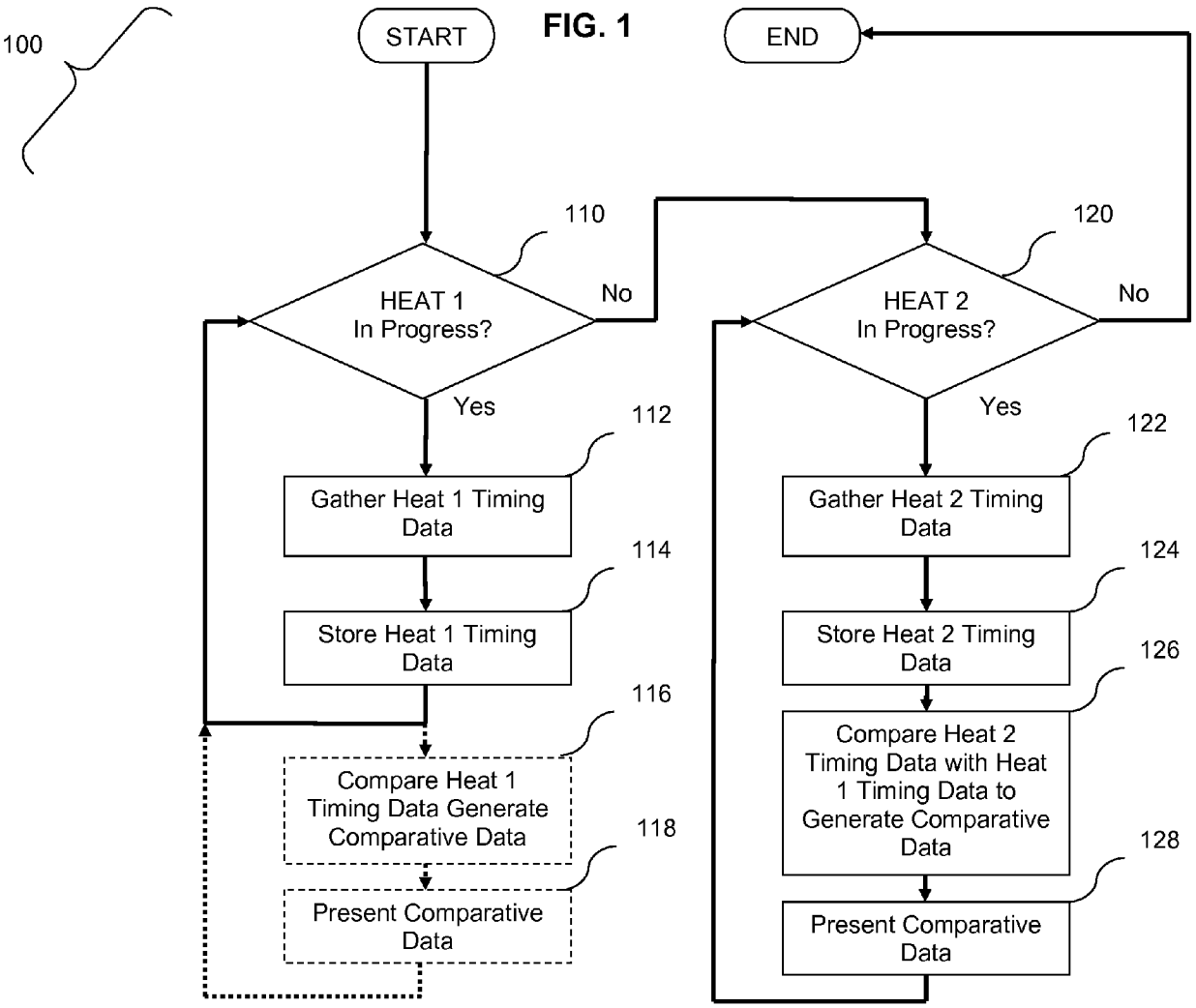
FIG. 1 is a flow chart illustrating a method according to the invention.

FIG. 1 illustrates an example method 100 according to the invention, whereby the audience can be kept informed of comparative data in an event having two or more heats.

During the first heat 110, timing data is gathered 112. Timing data may be for instance, the lap time for an athlete, split time, net time, cumulative time, or any other desired speed measurement. The timing data may be gathered periodically, continually, each length or lap, every other lap, split times, overall times for the heat, or any other suitable measurement. Timing data may be gathered using standard timing devices known in the art such as touch pads, radio frequency identification tags ("RFID"), RFID chip timers, bar codes, speed traps, light beam timing, stopwatch, or any other suitable device, and multiple sets of timing data may optionally be gathered using one or more timing methods and or identifying and tracking the a competitor.

As the timing data is gathered, it is stored 114. The timing data may be stored in any suitable electronic storage device, such as a memory card, hard drive, online database, or any other device known in the art.

Optionally, the data being gathered during the first heat may be compared 116 with earlier data stored during the first heat. This comparative data may be any desired comparison of the timing data being gathered and the stored timing data; for example, comparative data may be the fastest lap time, split time, or cumulative heat time for the event or other data of audience interest. This optional step is appropriate during the first heat when the timing data gathered includes segments that are less than an entire heat. For example, if lap times are being recorded during the first heat, each lap can be compared against previous laps from the first heat. The comparison of data may be performed by a computing device such as a hardware calculation device or computer such as a software program executing on a processor of a personal computer, portable digital assistant, iPhone™ or any other suitable computing device known in the art. This comparative data is then presented 118 to the audience of the sports competition. The comparative data may be presented to attendees using one or more displays such as an electronic scoreboard or television display, website, text message, portable digital assistant, iPhone,™ or any other suitable device for displaying data.

During the second heat 120, timing data is gathered 122, stored 124 and subsequently compared 126 with the timing data gathered during the first heat and earlier in the second heat to generate comparative data. Subsequently during the second heat 120, the comparative data is presented 128 to the competition attendees, e.g. via a display. These steps can be repeated for any number of additional heats.

It should be noted that comparative data can include comparative timing data, or scoring data that has been derived from timing data. Comparative timing data can include any timing calculation performed on the timing data. For instance, comparative timing data could be presented based on the comparative heat time between a competitor's heat time and the best heat time. Scoring data can be any other calculation of interest performed based on the heat ranking of competitors using timing data, which might, for example, be the lowest team score based on finishing last in an upcoming final heat or might be the score outcome expected based on a likely outcome. For instance, a ranking of a competitor's time within the heat, or a qualification designation, or any other categorization based on the competitor's time in the heats could be used to project scoring data based on heat times and ranking of results. Scoring data can also be used to present to the audience the results needed in a particular event to win a competition for a particular team. For example, an audience member might want to know that a particular team needs to place $1^{st}$, $3^{rd}$ and $7^{th}$ to win a meet or competition, so as to have an expectation of what needs to happen for supporters of a particular team.

It should also be noted that comparative data can be displayed differently for different events. For example, in a 100 meter ("m") event in swimming, 50 m split times may be displayed; however, in a 400 m relay, 50 m split times, 100 m split times and the cumulative relay time may be displayed, in three columns. This represents an advance over current practice, where 50 m splits and event cumulative times are displayed, regardless of the swimming event, limiting the understanding of the relevant splits needed to understand relevant performance measures and requiring the audience, especially coaches to calculate 100 m and/or 200 m splits manually, for example.

Figure 2:
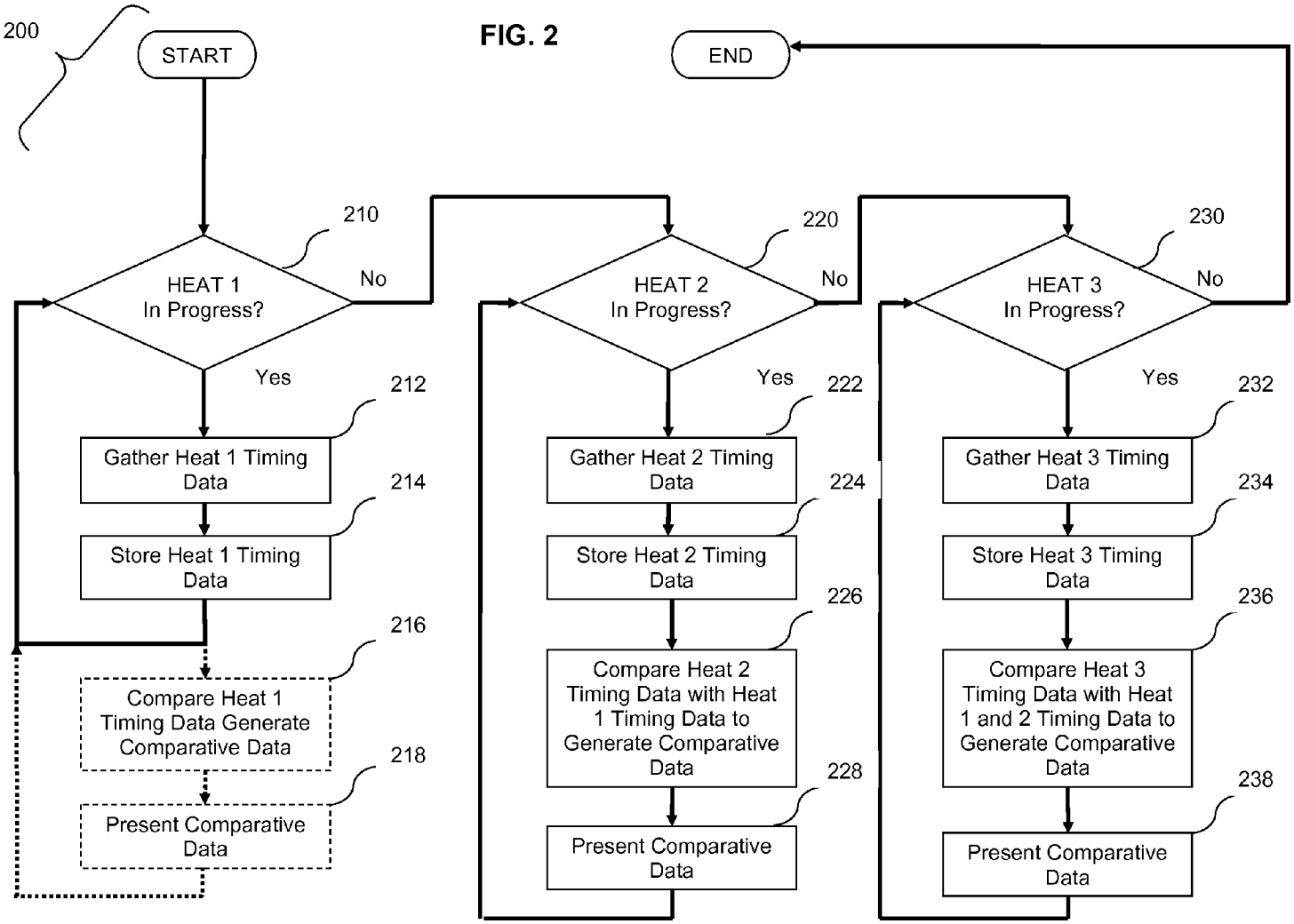
FIG. 2 is a flow chart illustrating a method according to the invention.

FIG. 2 illustrates another example method 200 according to the invention, whereby the audience can be kept informed of comparative data in an event having three heats.

During the first heat 210, timing data is gathered 212, and stored 214. Optionally, the data being gathered during the first heat may be compared 216 with earlier data stored during the first heat. This optional step is appropriate during the first heat when the timing data gathered includes segments that are less than an entire heat. This comparative data is then presented 218 to the audience of the sports competition.

During the second heat 220, timing data is gathered 222, and stored 224. The data being gathered during the first heat is compared 226 with timing data stored during the first heat to generate comparative data. For example, when the timing data gathered includes segments that are less than an entire heat such as lap time, the time being gathered can be compared with all lap times from the first heat or earlier in the second heat. When the timing data gathered is a cumulative heat time, only one comparison will be made at the end of the heat. This comparative data is then presented 228 to the audience of the sports competition.

During the third heat 230, timing data is gathered 232, and stored 234. The data being gathered during the third heat is compared 236 with timing data stored during earlier heats, or earlier in the third heat to generate comparative data. For example, when the timing data gathered includes segments that are less than an entire heat such as lap time, the time being gathered can be compared with all lap times from the first heat, the second heat, or earlier in the third heat. When the timing data gathered is a cumulative heat time, only one comparison will be made at the end of the heat. This comparative data is then presented 238 to the audience of the sports competition.

Figure 3:
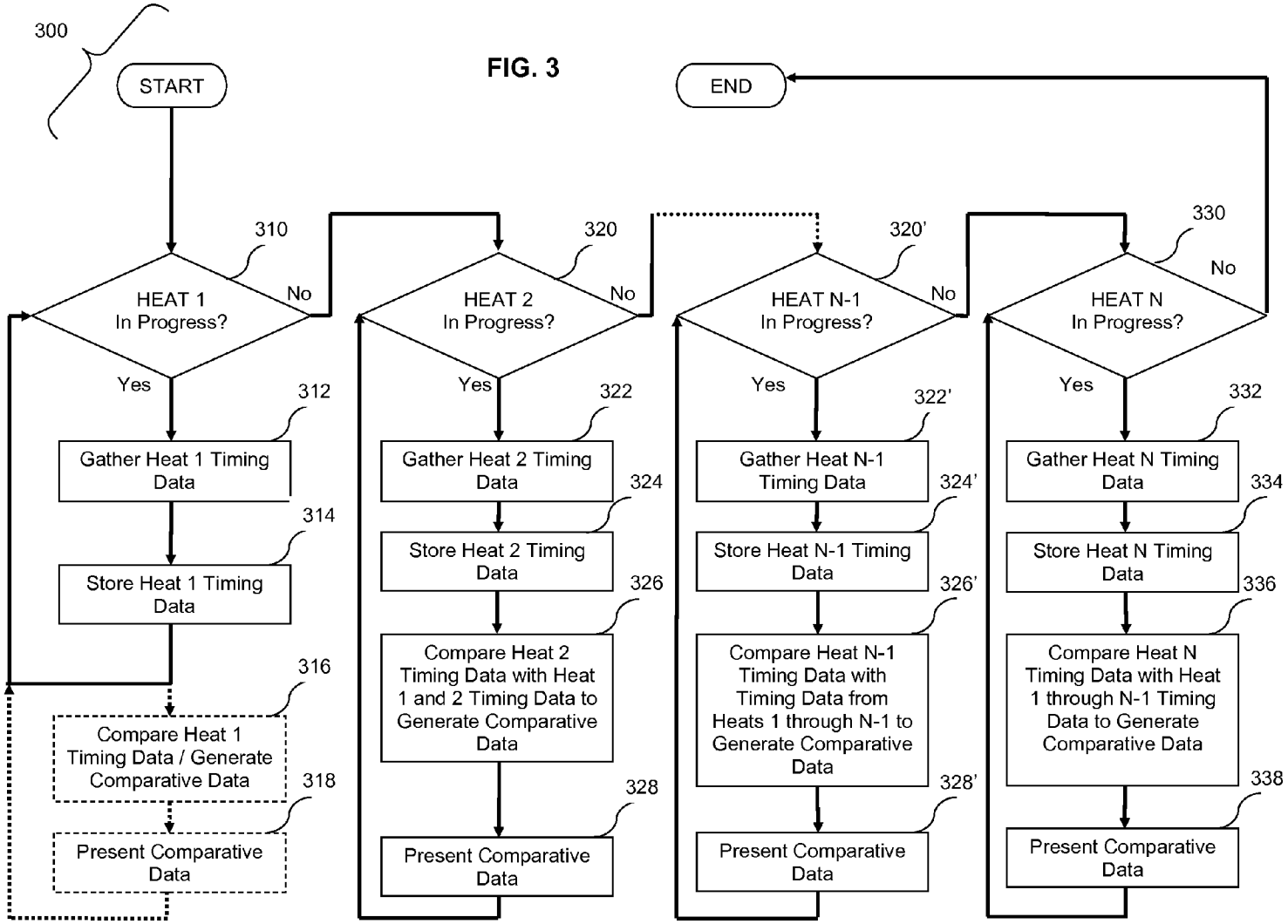
FIG. 3 is a flow chart illustrating a method according to the invention.

It should be clear based on the forgoing that this method can be applied to events having an arbitrary number of heats. FIG. 3 illustrates an example of such a method.

During the first heat 310, timing data is gathered 312, and stored 314. Optionally, the data being gathered during the first heat may be compared 316 with earlier data stored during the first heat. This optional step is appropriate during the first heat when the timing data gathered includes segments that are less than an entire heat. This comparative data is then presented 318 to the audience of the sports competition.

During each heat from the second heat through heat N-1, 320, 320', timing data is gathered 322, 322', and stored 324, 324'. The data being gathered during the first heat is compared 326, 326' with timing data stored during the first heat. For example, when the timing data gathered includes segments that are less than an entire heat such as lap time, the time being gathered can be compared with all lap times from earlier heats or earlier in the current heat. When the timing data gathered is a cumulative heat time, only one comparison will be made at the end of the heat to all prior heats. This comparative data is then presented 328, 328' to the audience of the sports competition.

During the last heat N 330, timing data is gathered 332, and stored 334. The data being gathered during heat N is compared 336 with timing data stored during earlier heats, or earlier in heat N. For example, when the timing data gathered includes segments that are less than an entire heat such as lap time, the time being gathered can be compared with all lap times from earlier heats, or earlier in heat N. When the timing data gathered is a cumulative heat time, only one comparison will be made at the end of the heat. This comparative data is then presented 338 to the audience of the sports competition.

Figure 4:
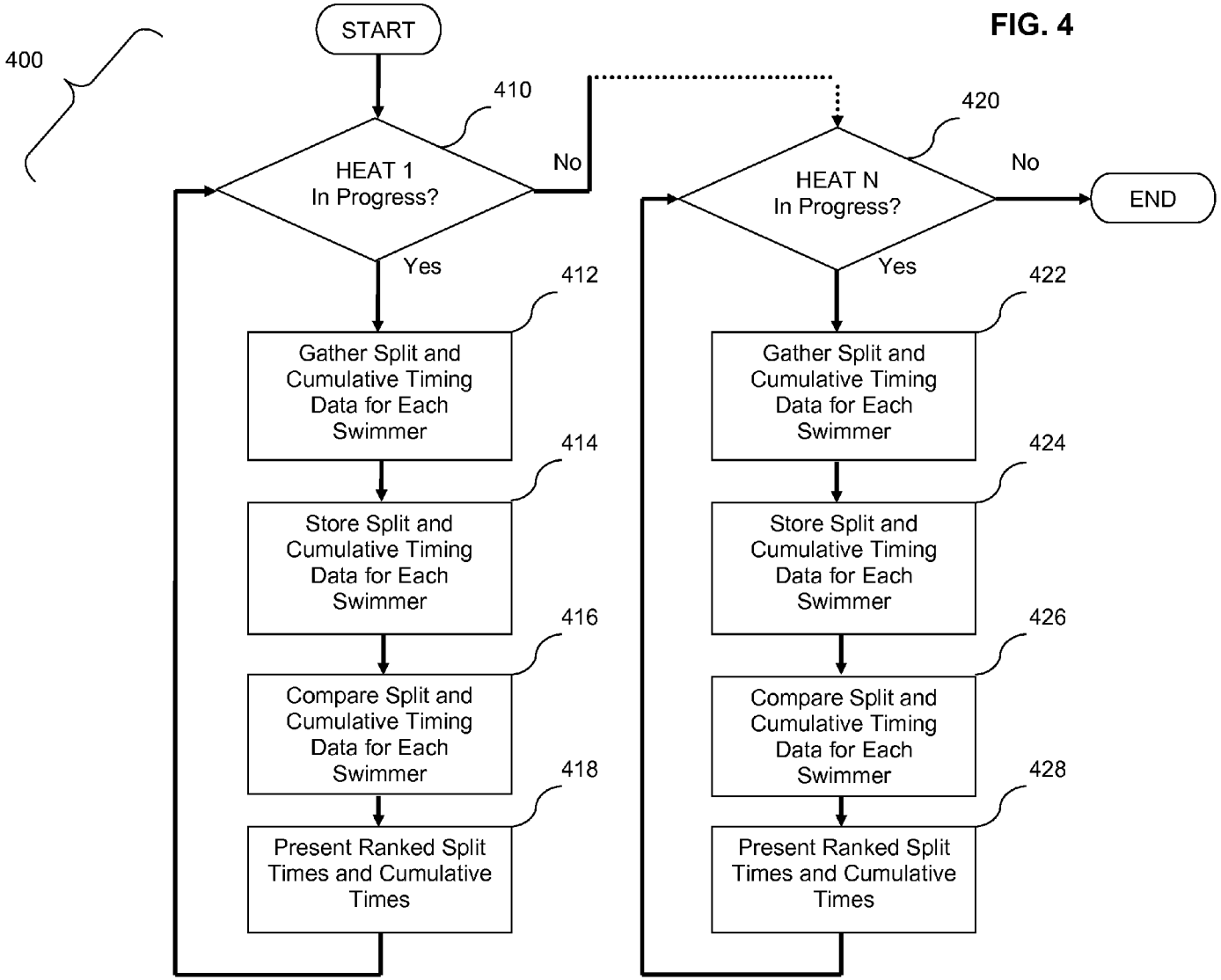
FIG. 4 is a flow chart illustrating a method according to the invention.

FIG. 4 illustrates an example application 400 of a method according to the invention, whereby the audience can be kept informed of the best split time in a 400 Meter Freestyle timed final swimming event having two heats. In this example event, 50 meter and 100 meter splits are of interest to the audience, as well as cumulative time. In general, split time is the amount of elapsed time for a fraction of the total event length. In swimming, for example, this can be calculated from an individual lap time or an accumulation of lap times, with each lap being the elapsed time for swimming one length of the pool (typically 50 meters in long course competitions).

During the first heat 410, timing data is gathered 412. In this case for example, the timing data of interest are the split times for each swimmer in the first heat, as well as their cumulative time within the heat, and among all heats, although any desired combination of comparative data could be provided. This timing data is typically gathered after each lap of the pool, and may for example be registered by the swimmer contacting a touch pad on the pool wall at the end of their lane. As the timing data is gathered, it is stored 414. After each split of interest, which in this case is at 50 meters and 100 meters, the splits are compared 416 and the ranked split times are presented 418 to the audience. At the end of the first heat, the cumulative times are compared 416 within the heat and among all heats. These ranked cumulative times by competitor or team are then presented 418 to the audience.

During the second and subsequent heats, 420, timing data is gathered 422 for each swimmer, stored 424, and subsequently compared 426 to generate the desired comparative data (splits and cumulative times). In this example, the ranked 50 m and 100 m splits are presented 428 to the audience, as well as the ranked cumulative times within the heat, and within the competition.

The invention contemplates that the comparative data can also be used to calculate and present any other information of interest, such as the times needed to qualify for finals in events that are not timed finals. For example, in an event where eight competitors will make the finals, the minimum qualifying time can be recalculated after each heat to present the eight top qualifying times, or to present the minimum qualifying "time to beat", for example. This can be extended to events having multiple levels of finals, for instance, championship finals, consolation finals, and bonus finals, in which case, a list of qualifying times or the minimum qualifying time for each could be displayed.

The invention further contemplates that competition data will not necessarily be confined to the current competition. For instance, the audience can be kept informed of comparative historical data in an event having an arbitrary number of heats. Historical data may include timing data for past competitions related to a given heat. For example, in a 400 meter freestyle swimming event, it may be of interest to compare 100 meter split times to the historical record of Olympic 100 meter split times in that event, while in a 500 yard freestyle swimming event, it may be of interest to compare 100 yard split times to the historical record of NCAA split times in that event. It will be clear to those having skill in the art that many combinations of events and historical timing data are possible.

Figure 5:
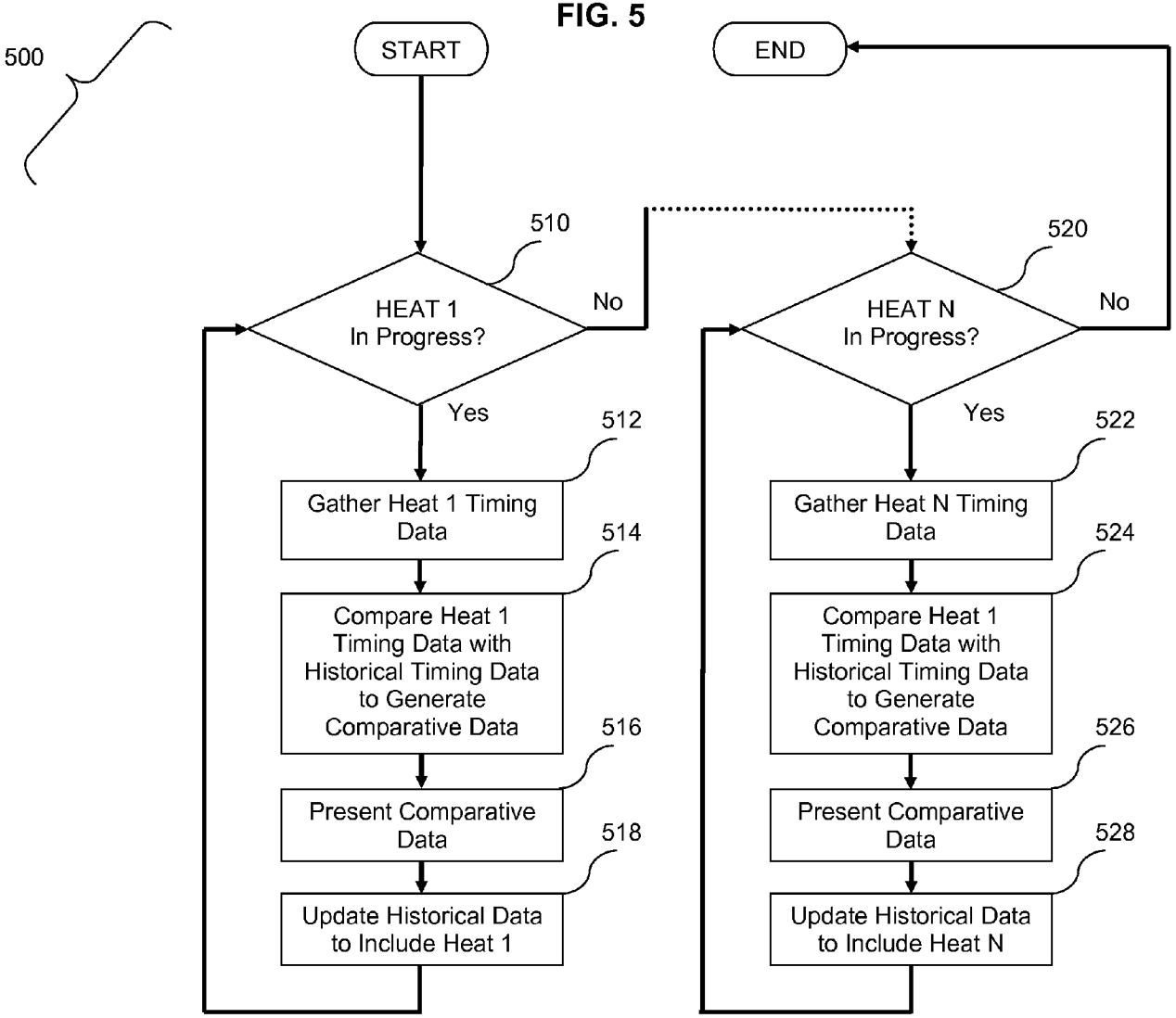
FIG. 5 is a flow chart illustrating a method according to the invention.

FIG. 5 illustrates another example method 500 according to the invention, whereby the audience can be kept informed of comparative historical data. During the first heat 510, timing data is gathered 512, and compared 514 with historical timing data to generate comparative data. This comparative data is then presented 516 to the audience of the sports competition. Subsequently, the historical data is updated 518 to include the data gathered during the first heat.

During all subsequent heats including during the final heat N 520, timing data is gathered 522, and compared 524 with historical timing data to generate 526 comparative data. This comparative data is then presented to the audience of the sports competition. Subsequently, the historical data is updated 528 to include the data gathered during the current heat.

Comparison with, and updating of the historical record can have the advantage of allowing attendees to appreciate the performance of athletes across time, and to be apprised of any new records set or qualifications achieved.

Figure 6:
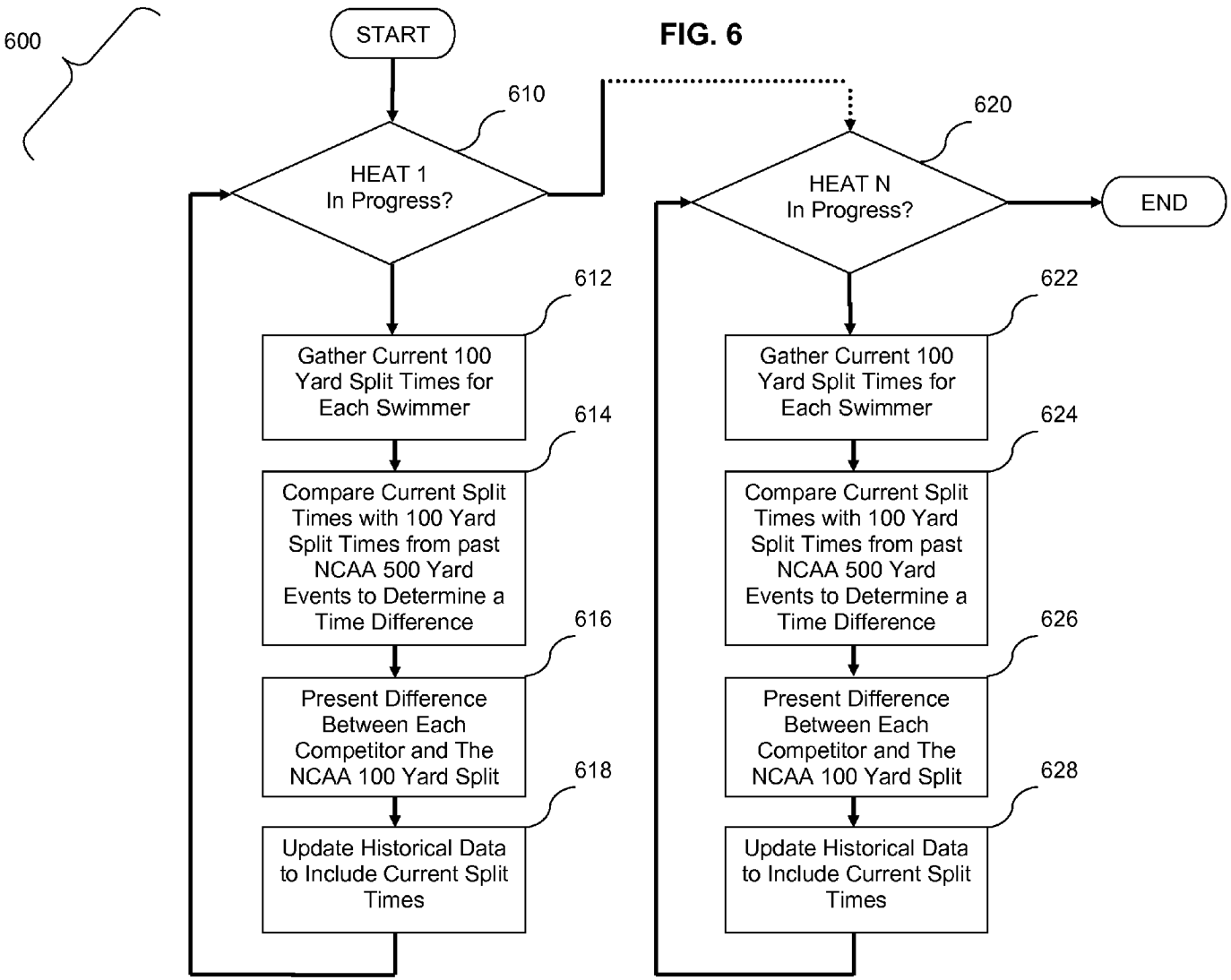
FIG. 6 is a flow chart illustrating a method according to the invention.

For example FIG. 6 illustrates an example method 600 according to the invention, the audience can be kept informed of the difference between current 100 yard split times for each swimmer in a 500 yard freestyle event having an arbitrary number (N) of heats, and the current NCAA record for 100 yard split times in past NCAA 500 yard freestyle events.

During the first heat 610, 100 yard split times are gathered 612 for each swimmer, and compared 614 with 100 yard split times from past NCAA 500 yard freestyle events to determine the time difference between each swimmer's split and the NCAA record split. The time differences are then presented 616 to the audience of the sports competition. Subsequently, the historical data is updated 618 to include the data gathered during the first heat.

It is understood that any historical event can be compared with a current event, for instance, a non NCAA event could be compared with NCAA historical data. In this case, NCAA historical records would not be updated with the current data.

During all subsequent heats including during the final heat N 620, 100 yard split times are gathered 622, and compared 624 with the historical timing data to generate 626 time differences with the NCAA record. These time differences are then presented to the audience of the sports competition. Subsequently, the historical data is updated 528 to include the data gathered during the current heat.

Many other kinds of historical comparisons are possible. For example, if a competitor posts a time, (e.g. cumulative, split, relay leadoff time, etc.) which, based on the historical record for the league, qualifies them to compete in a national or zone meet or qualifies as a record time, this new time and record can be immediately displayed to the audience with an appropriate level of highlighting and exclamation to inform the audience immediately of this accomplishment.

Figure 7:
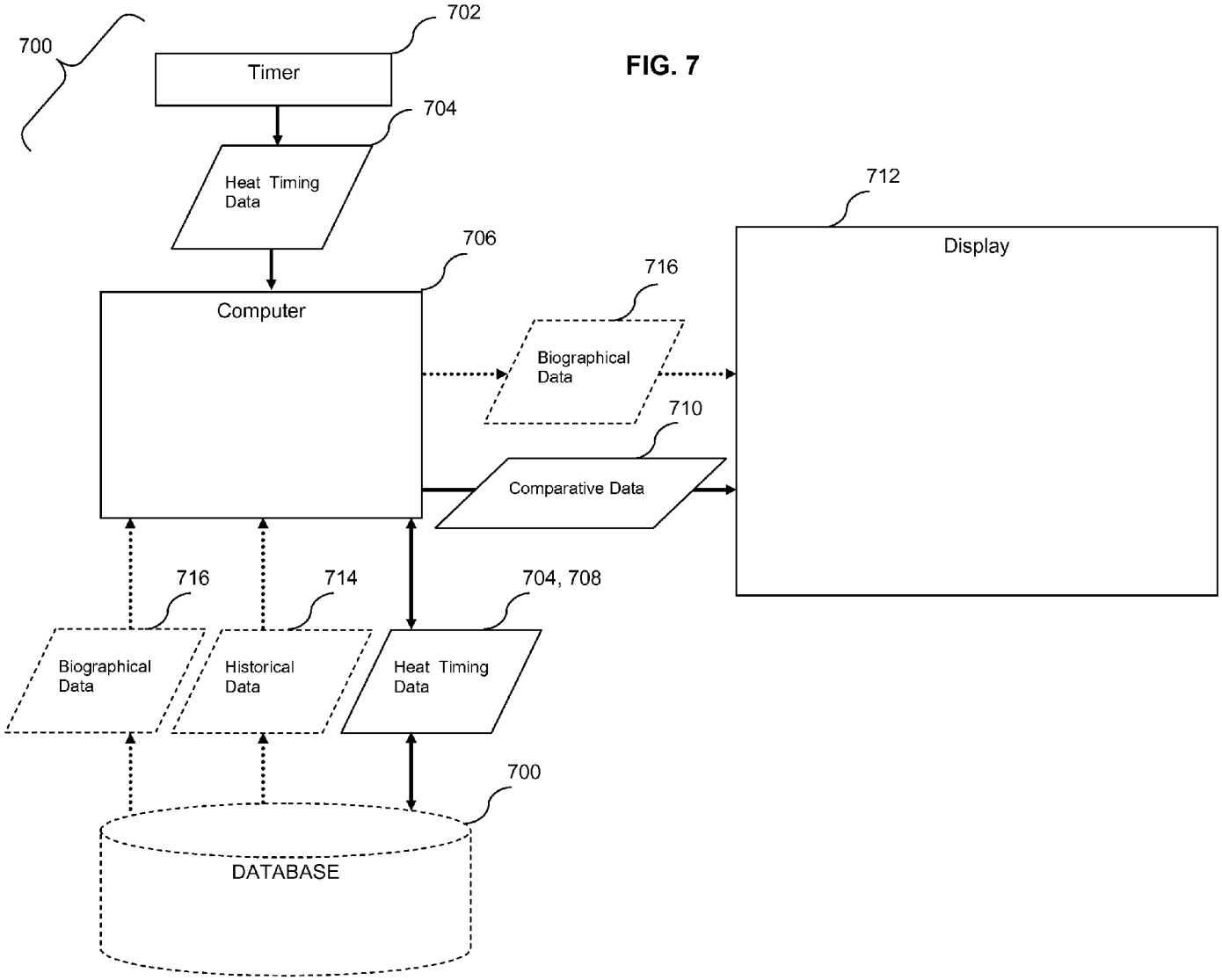
FIG. 7 is a block diagram illustrating an example system according to the invention.

FIG. 7 illustrates an example system according to the invention. Timer 702 gathers timing data 704 during a first heat, and transmits it to a computer 706. Computer 706 stores timing data 704, and compares it to earlier stored timing data 708 to generate comparative data 710. Computer 706 transmits comparative timing data 710 to display 712.

Optionally, timing data 704 can be compared to historical timing data 714. Optionally, computer 706 retrieves biographical information 716 or other information relating to a given swimmer, team, sponsor, or related entity and transmits this information to display 712.

Providing an improved experience for the audience of a sports competition does not depend upon any specific information. A substantially improved experience can be provided by marrying information, media and meet results into a meaningful dashboard by which the audience is better informed of the information that they need addressing their specific interest.

Figure 8:
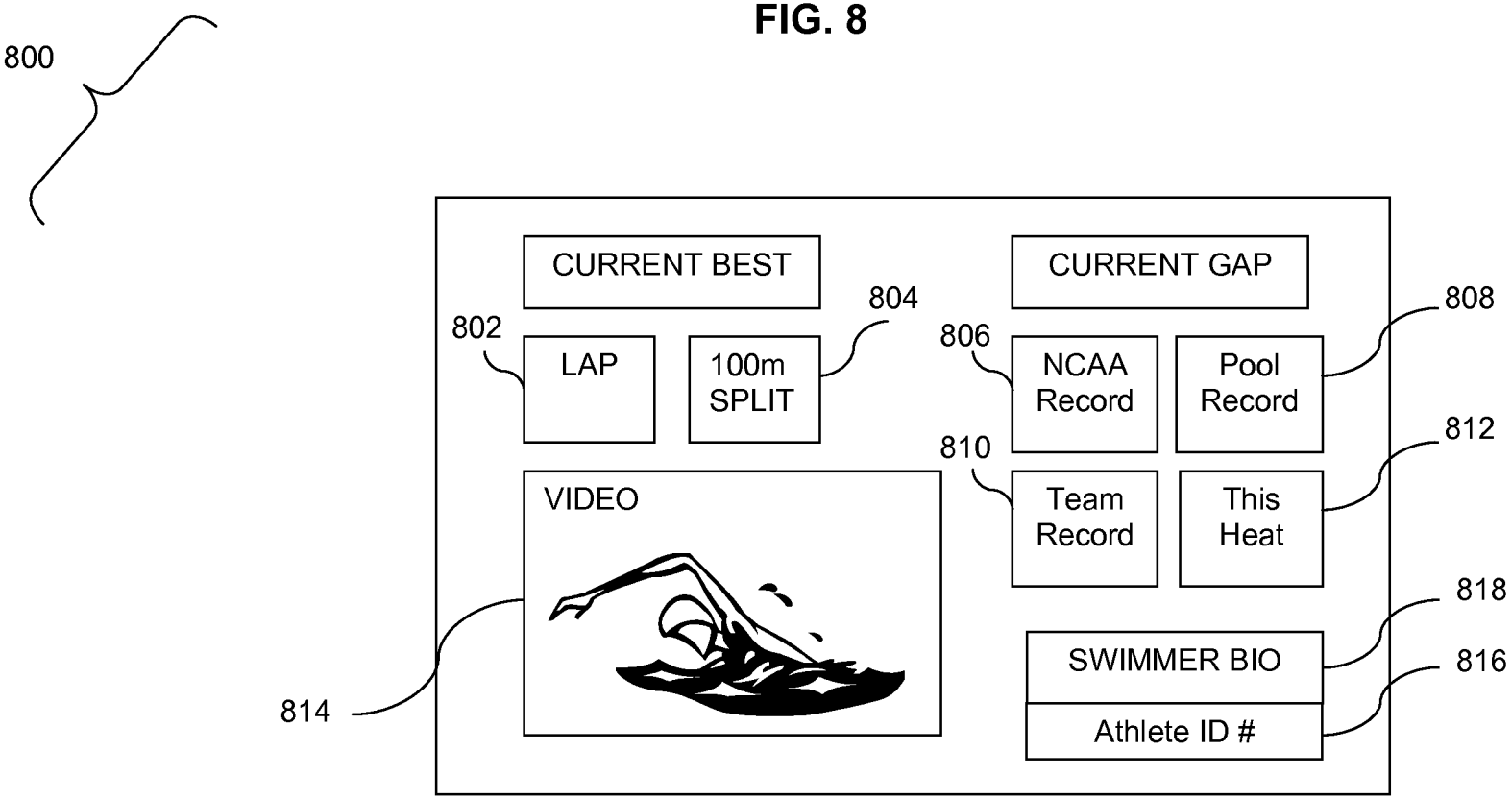
FIG. 8 is an illustration of an example software application according to the invention.

FIG. 8 illustrates an example dashboard software application 800 according to the invention. The dashboard application is contemplated to be run on a personal communication device. The user can choose from a selection of comparison data to be delivered to the phone in real time. For example, a user may wish to view a swimmer's current best lap time 802 or best 100 meter split time 804. Alternatively, the user may choose to view the difference in time between a swimmers' current best time and the NCAA 806, Pool 808, Team 810 records, or against other swimmers in the current heat 812. Any other combination of race data could also be facilitated through the application. Optionally, video 814 of the competition can be streamed simultaneously with the comparison data, as well as still photos or photo finish photos (not shown). Optionally, scheduling information can be transmitted to the phone via the application, to let an attendee know when a given swimmer's next heat is scheduled to take place, and to provide updates to the schedule (not shown).

Optionally, the user can select a particular swimmer using a unique identifier such as a league ID number or any other similar identifier 816. A unique identifier 816 could be a swimmer identification number provided through the NCAA, USA swimming, FINA, or other governing athletic body, which is linked to an individual's identity throughout their lifetime. In the case of existing identifiers, those identifiers can be associated or linked on a secure website which would allow swimmers, for example, who swim in the NCAA to later swim in Masters using either the same identifier or an identifier which is linked to a previous identifier so that lifetime results can be tracked.

Optionally, the user can receive comparative data, biographical data 818 about that swimmer via application 800. For example, the user could automatically be streamed video when it is available, could be continually updated as to the swimmer's current cumulative time, best lap time, split time, or historical best times for the event, and could be notified if a personal best, league record, or finals qualification was achieved. Other example uses of the application 800 include placing wagers on a given swimmer. Location-aware and other advertisements related to the local vicinity of the pool, swimming related merchandise and services, and the like can also be provided to the user via the application 800.

Figure 9:
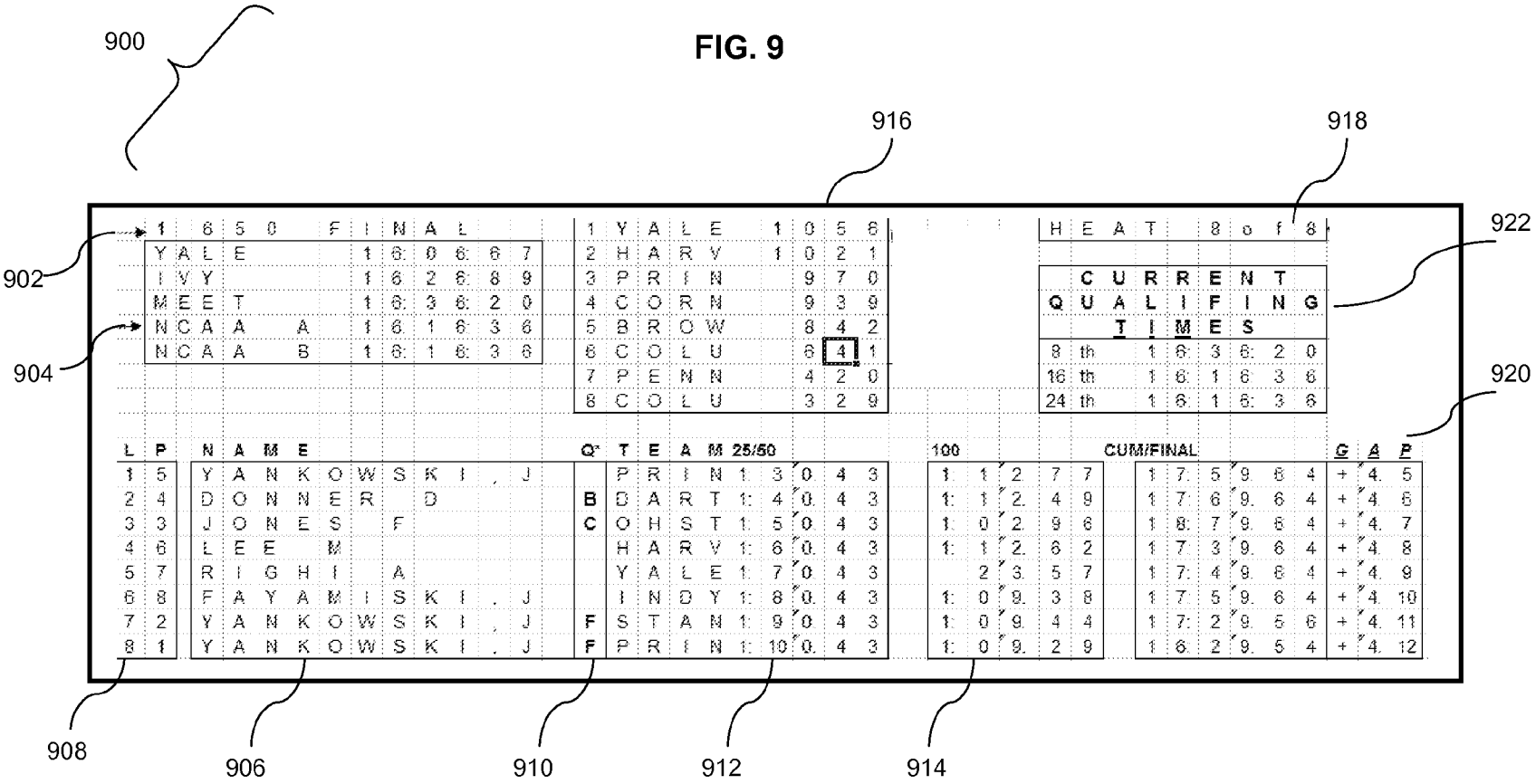
FIG. 9 is an illustration of an example display according to the invention.

FIG. 9 illustrates an example dashboard 900 according to the invention. Dashboard 900 may be presented on a personal communication device in a manner similar to FIG. 8, and may be suitable for display as a scoreboard at a sports competition. Dashboard 900 can present any comparative timing and historical information described more fully above, along with other relevant information. For example, dashboard 900 can present to attendees such information as the event name 902, historical record times 904, competitor identification information 906, competitor lane and place within the heat 908, indications of qualification for finals, consolation finals, bonus finals, and other qualifications for each competitor in the heat 910, various split times, 912, 914 team scores for the current competition 916, heat number 918, gap times between each swimmer and first place for the heat or competition, or a historical record 920, and times needed for various qualifications 922.

Although the invention has been described with reference to a particular arrangement of parts, features and the like, these are not intended to exhaust all possible arrangements or features, and indeed many modifications and variations will be ascertainable to those of skill in the art.

What is claimed is:

1. A method of presenting data to the audience of a competition, the method comprising the steps of:

gathering, via a timing device, first heat timing data during a first heat;

receiving, via a communication device, a participant selection indicative of an alert preference for a competitor;

comparing, via a computing device, the participant selection to the first heat timing data and to a competition schedule;

generating, via the computing device, an alert based on said comparing step;

presenting, via a display, the alert indicative of when the competitor's next scheduled heat will take place;

further presenting via the display a video feed associated with the competitor's next scheduled heat.

2. The method of claim 1 further comprising:

further presenting via the display a qualifying threshold to beat by the competitor in the competitor's next scheduled heat in order to advance or secure a desired placement.

3. The method of claim 1 wherein historical timing data is downloaded from the internet or from a database and further comprising:

further presenting historical timing data via the display.

4. The method of claim 3 wherein historical timing data comprises Olympic records, Collegiate records, National Records, Age Group Records, High School Records or Event Location Records.

5. The method of claim 3 wherein historical timing data comprises a record of lap times for a plurality of competitors within the competition.

6. The method of claim 3 wherein historical timing data is a record of times in an event for a particular competitor within the competition, within a particular season, or in all competitions.

7. The method of claim 3 wherein the comparing step includes comparing the timing data to the competition schedule to determine a scheduling adjustment, wherein the scheduling adjustment is indicative of a time change associated with the competition schedule; and said alert generated as indicative of the scheduling adjustment.

8. The method of claim 1 wherein the alert is presented to indicate a projected delay for the competitor's next scheduled heat.

9. The method of claim 1 further comprising:

gathering, via the timing device, next heat timing data during a next heat;

comparing, via the computing device, the participant selection to the next heat timing data, the competition schedule and to the alert to determine a schedule change;

presenting, via a display, an update alert indicative of the schedule change to the audience.

10. A method of presenting data to the audience of a competition, the method comprising the steps of:

gathering, via a timing device, timing data during a first heat;

receiving, via a communication device, a participant selection indicative of an alert preference for a competitor;

comparing, via a computing device, the participant selection to timing data and to a competition schedule;

generating, via the computing device, an alert based on said comparing step, the alert indicative of when the competitor's next scheduled heat will take place;

associating, via the computing device, the alert with a video identification;

presenting, via a display, the alert and the video identification.

11. The method of claim 10 further comprising:

receiving a selection indicative of the video identification;

presenting via the display a video associated with the video Identification.

12. The method of claim 11 wherein the video is a streaming video feed.

13. The method of claim 10 wherein the alert preference is indicative of an alert time for transmission of the alert prior to the competitor's next scheduled heat.

14. A system for presenting data to the audience of a competition, the system comprising:

a timing device recording heat timing data for each competitor during each heat;

a database including a schedule identifier stored thereon, the schedule identifier indicative of a schedule for the competition a computing device having software executing thereon, the software receiving a participant selection indicative of an alert preference for a competitor;

said software comparing the participant selection to the heat timing data and to the schedule identifier to generate an alert indicative of when the competitor's next scheduled heat will take place.

15. The system of claim 14 wherein said computing device is connected to the timing device and compares the heat timing data during each heat to historical timing data to generate comparative data; and said software generating a threshold to beat by a competitor in a particular heat at that point in the event in order to advance or secure a desired placement in the event, the threshold to beat for display.

16. The system of claim 14 wherein said software associates a video feed with the alert and further comprising;

said software further transmitting the video feed to the personal computing device.

17. The system of claim 15, wherein the historical timing data is associated with athlete biographical information stored in a database wherein the athlete biographical information is presented via a display.

18. The system of claim 15, further comprising a software application executing on the computing device; the software application presenting a selection of comparative data to a user.

19. The system of claim 15, wherein video of the competition is streamed to a display.

20. The system of claim 17, wherein the computing device is a personal communication device, PDA, smartphone, or iPhone.

21. A system for presenting data to the audience of a competition, the system comprising:

a computing device historical timing data accessible by said computing device;

a competition schedule having a plurality of heats associated therewith, said competition schedule accessible by said computing device and associating at least one competitor with each heat;

software executing on said computing device for comparing said historical timing data to said competition schedule to determine a projected placement for each heat based on said historical timing data;

software executing on said computing device for comparing the projected placement with a scoring system associated with the competition to generate a projected competition score for display to the audience.

22. The system of claim 21 further comprising:

a timing device recording event timing data for each competitor during each heat;

software executing on said computing device for updating the projected competition score based on the timing data.

23. The system of claim 22 wherein the projected competition score is updated after each heat.

24. The system of claim 22 wherein the historical timing data is associated with athlete biographical information stored in a database wherein the athlete biographical information is presented via a display.

25. The system of claim 22 wherein the projected competition score is presented to the audience via a mobile device.

26. The system of claim 22 wherein the record of lap times are indicative of a personal record for the at least one competitor.

27. The system of claim 22 wherein the historical timing data comprises most recent lap times for the at least one competitor.

* * * * *